US007323983B2

(12) United States Patent
Bergman

(10) Patent No.: US 7,323,983 B2
(45) Date of Patent: Jan. 29, 2008

(54) DEVICE FOR ALERTING WHEN UMBRELLA IS LEFT BEHIND

(76) Inventor: Matthew Bergman, 10818 Hob Nail Ct., Potomac, MD (US) 20854

( * ) Notice: Subject to any disclaimer, the term of this patent is extended or adjusted under 35 U.S.C. 154(b) by 160 days.

(21) Appl. No.: 11/136,375

(22) Filed: May 25, 2005

(65) Prior Publication Data

US 2006/0267761 A1 Nov. 30, 2006

(51) Int. Cl.
*G08B 1/08* (2006.01)

(52) U.S. Cl. ..... 340/539.23; 340/539.1; 340/568.1; 340/686.1; 340/686.6; 340/692; 135/15.1

(58) Field of Classification Search ..... 340/539.23, 340/568.1, 539.1, 539.21, 572.2, 686.1, 686.6, 340/692, 568.8, 571, 309.16, 328, 327; 135/15.1, 135/25.4

See application file for complete search history.

(56) References Cited

U.S. PATENT DOCUMENTS 4,887,543 A * 12/1989 Rockhill ..... 116/201
5,046,446 A * 9/1991 Sumrall et al. ..... 116/200
5,160,000 A * 11/1992 Agha et al. ..... 190/102
5,952,921 A * 9/1999 Donnelly ..... 340/568.6
6,126,291 A * 10/2000 Chung-Kuang et al. .... 362/102
6,304,186 B1 * 10/2001 Rabanne et al. ..... 340/573.4
6,472,986 B1 * 10/2002 Sorriaux ..... 340/571
6,674,358 B1 * 1/2004 Tinsley ..... 340/7.63
6,696,950 B2 * 2/2004 Adolphson ..... 340/568.6
6,724,306 B1 * 4/2004 Parsley et al. ..... 340/568.1
6,836,212 B2 * 12/2004 Sawinski ..... 340/539.23
6,904,922 B2 * 6/2005 Tsai ..... 135/16

* cited by examiner

*Primary Examiner*—Davetta W. Goins
(74) *Attorney, Agent, or Firm*—Dickstein Shapiro LLP

(57) ABSTRACT

The present invention is for an umbrella with a device, called the umpod, built into the handle of the umbrella. When detached from the handle, the umpod serves as a receiver of a pulsating RF signal, or other electronic communication, sent from the handle of the umbrella. There is an transmitter located in the handle of the umbrella and a receiver located in the umpod. When the umpod is separated from the umbrella handle, the umpod is activated and when separated by more than a preset distance, the receiver senses the diminished strength of the communication signal and the umpod automatically goes into "alert" mode. In "alert" mode, the umpod vibrates and/or beeps until the umpod is brought back within the range of the preset distance from the umbrella handle.

18 Claims, 4 Drawing Sheets

DEVICE FOR ALERTING WHEN UMBRELLA IS LEFT BEHIND

BACKGROUND OF THE INVENTION

Umbrellas are one of the most common personal items to be lost or left behind. The present invention solves this problem by creating an umbrella that will "alert" the owner that he/she has left the umbrella behind.

BRIEF SUMMARY OF THE INVENTION

The present invention is for an umbrella with a device, called the umpod for purposes of this application, built into the handle of the umbrella. When detached from the handle, the umpod serves as the receiver of an electronic communication signal sent from a transmitter located within the handle of the umbrella. When the umpod separates from the umbrella by more than a preset distance, the umpod automatically goes into "alert" mode—vibrating and/or beeping until the umpod is brought back within the preset distance of the umbrella handle.

The umbrella user can detach the umpod from the umbrella handle and put it in his/her pocket or use the attached key ring to connect it to his/her belt buckle or keys before placing the umbrella on the ground or in the seat next to him/her. When he/she gets up from his/her seat and begins to leave without the umbrella, the umpod starts to vibrate and/or beep. It just reminded the owner of the umbrella that he/she left the umbrella under the table or chair. This will prevent the umbrella from being inadvertently left behind.

DETAILED DESCRIPTION OF THE INVENTION

Figure 1:
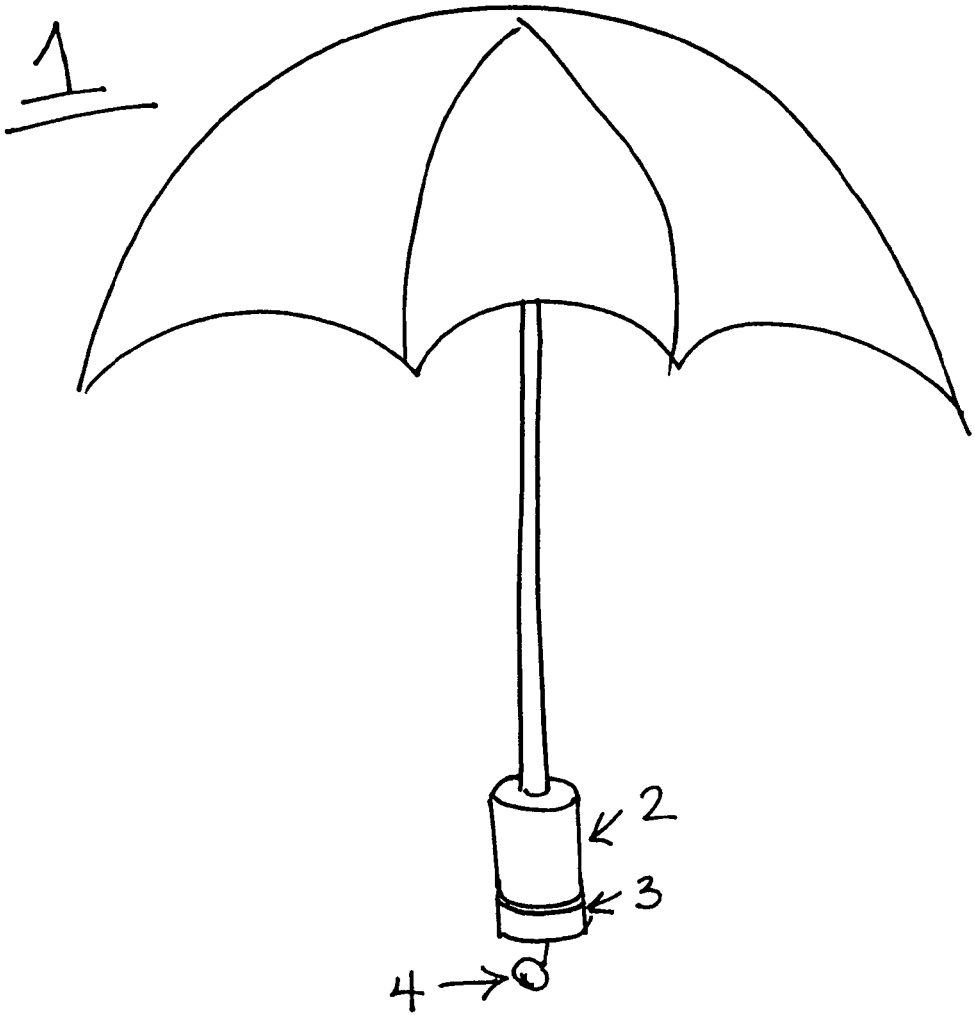
FIG. 1 is a depiction of an umbrella with the umpod attached to the handle, according to a preferred embodiment of the invention.

The present invention is for an umbrella with a device, called the umpod 3 for purposes of this application, built into the handle 2 of the umbrella 1. When detached from the handle 2, the umpod 3 serves as a receiver of an electronic communication signal, a pulsating RF signal 7 in the preferred embodiment, sent from the handle 2 of the umbrella 1. There is an RF transmitter 10, or any other suitable electronic communication device, located in the handle 2 of the umbrella 1 and a compatible receiver 11 located in the umpod 3. When the umpod 3 is separated from the umbrella handle 2 by more than a preset distance 8, the umpod 3 automatically goes into "alert" mode. In "alert" mode, the umpod 3 vibrates and/or beeps until the umpod 3 is brought back within the range of the preset distance 8 from the umbrella handle 2. The preset distance is either the maximum range of the signal 7 being transmitted or as any distance less than this maximum, as set by the user.

The user can detach the umpod 3 from the umbrella 1 handle 2 and put it in his/her pocket before placing the umbrella 1 on the ground or in the seat next to him/her. The umpod 3 can also have a key ring 4 attached to it to easily facilitate attachment to the user's belt or keys. When he/she gets up from his/her seat and begins to leave without the umbrella 1, the umpod 3 starts to vibrate and/or beep when removed more than the preset distance 8 away from the handle 2. This reminds the owner of the umbrella 1 that he/she left the umbrella 1 under the table or on the chair. This will prevent the umbrella 1 from being inadvertently left behind.

A preferred embodiment of the invention is shown in FIGS. 1-4.

FIG. 1 shows the umbrella 1 with the umpod 3 attached to the handle 2. As shown, when attached to the handle 2 of the umbrella 1, the umpod 3 does not inhibit the function of the umbrella 1; it functions as part of the handle 2. FIG. 1 demonstrates the configuration of the umbrella 1 during normal use as an umbrella. When attached to the handle 2, the umpod 3 is inactive.

Figure 2A:
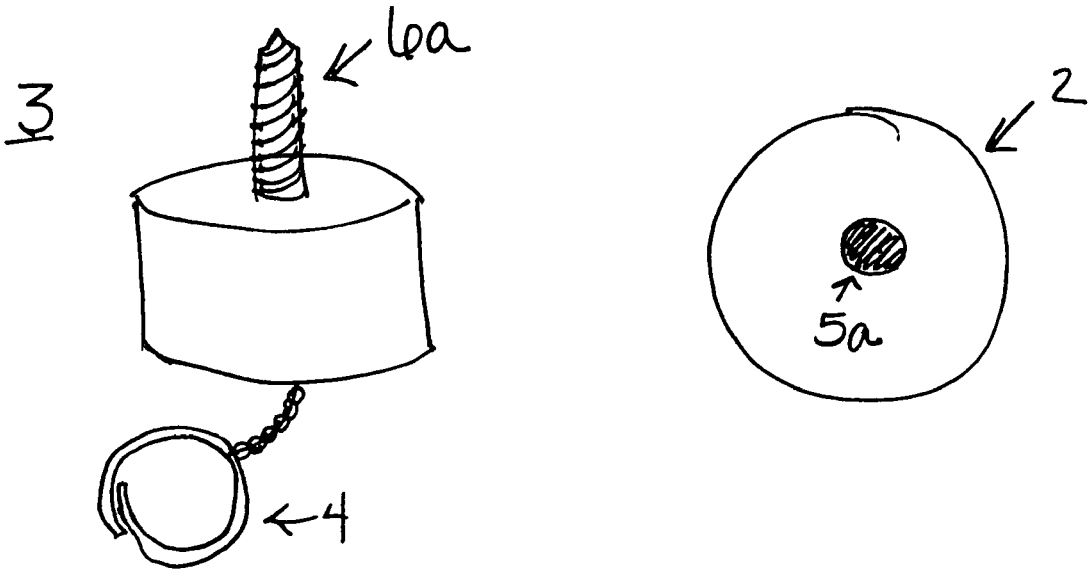
FIG. 2A is a depiction of the screw-on connection method of the umpod and the opening on the end of the handle, according to a preferred embodiment of the invention.
Figure 2B:
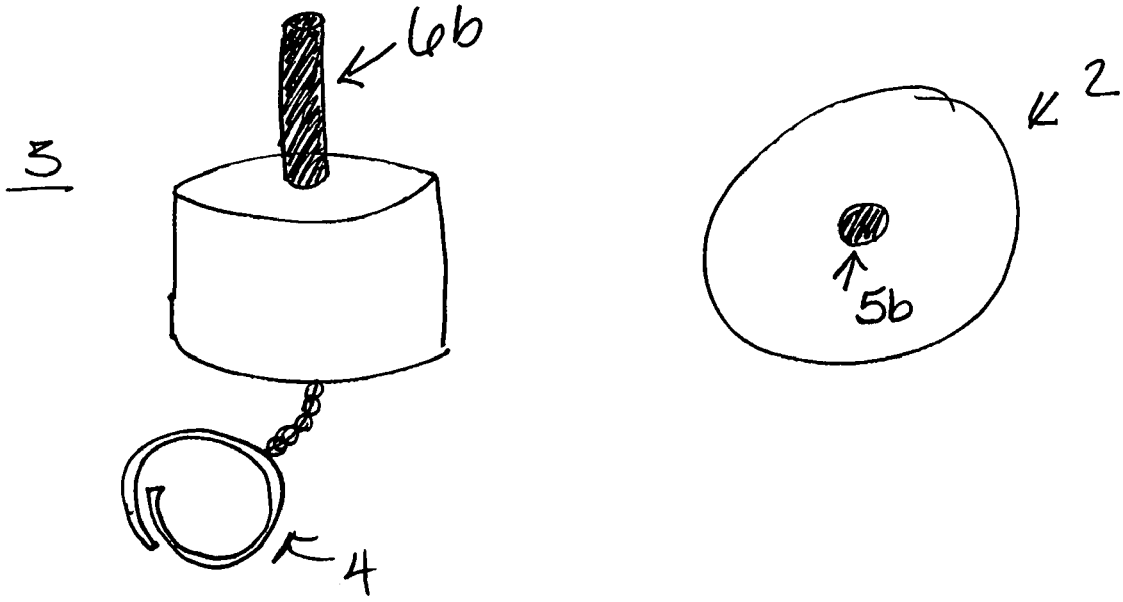
FIG. 2B is a depiction of the metal rod connection method of the umpod and the opening on the end of the handle, according to a preferred embodiment of the invention.

The umpod 3 is attached to the handle by any method known in the art. Exemplary methods of attachment include screwing the screw tip 6*a* of the umpod 3 into the threaded opening 5*a* on the end of the handle 2 of the umbrella 1 of by inserting the metal rod 6*b* into the opening 5*b* on the end of the handle 2. Either exemplary method can be used to attach the umpod 3 to the umbrella 1 handle 2. FIG. 2A depicts the connection of the umpod 3 by screw 6*a* and the threaded opening 5*a* on the end of the handle 2. FIG. 2B depicts the connection of the umpod 3 by metal rod 6*b* and the opening 5*b* on the end of the handle 2. The umpod 3 may be attached to the handle 2 by other methods as well and is not limited to the screw-on or metal rod options. FIGS. 2A and 2B also depict the key ring 4 that can be attached to the umpod 3 to facilitate attaching the umpod 3 to the user when separated from the handle 2.

Incorporated into the handle 2 and into the umpod 3 are an RF transmitter 10 and RF receiver 11 respectively. In the preferred embodiment, this is accomplished by use of small battery-operated circuits built into the handle 2 and umpod 3 and capable of transmitting/receiving RF signals 7. The pulsating RF signal 7 can be replaced with any other form of equivalent electronic communication method known in the art. Additionally, any equivalent hardware may be used to transmit and receive the electronic communication signals.

Figure 3A:
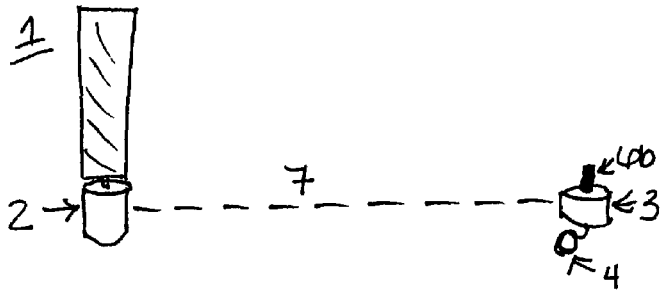
FIG. 3A is a depiction of the RF signal communication being sent to the umpod, according to a preferred embodiment of the invention.
Figure 3B:
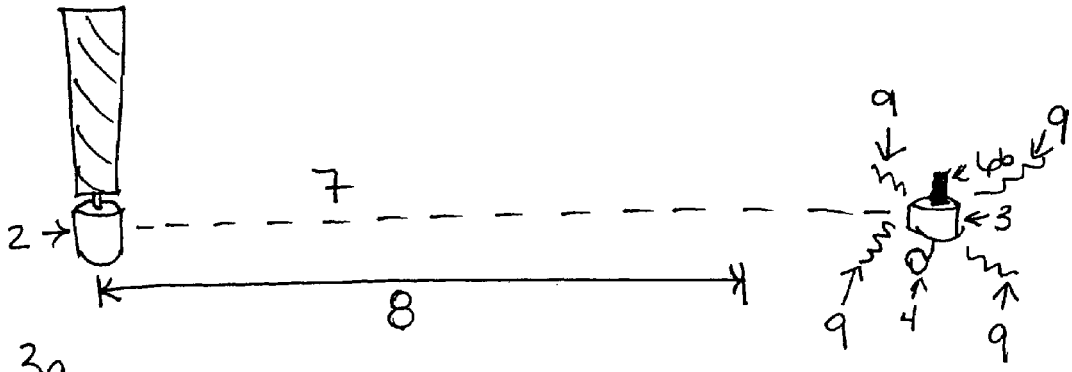
FIG. 3B is a depiction of the RF signal communication being sent to the umpod where the umpod is greater than the preset distance away from the handle and is in alert mode, according to a preferred embodiment of the invention.

As shown in FIG. 3A, when the umpod 3 is detached from the umbrella 1 handle 2, a pulsating RF signal 7 is sent from the transmitter 10 located within the handle 2. This pulsating RF signal 7 is received by the receiver 11 located within the umpod 3. The signal 7 is activated when the umpod 3 is detached from the handle 2. This can be accomplished for example, by using a switch in the transmitter 10 and receiver 11 or by sensing when the screw tip 6*a* or rod 6*b* is no longer in contact with the interior of the handle 2. The switches would be in the "off" position when the umpod 3 is connected to the handle 2 and in the "on" position when the umpod 3 is detached from the handle 2. The activation of the signal 7 can also be achieved by any acceptable method known in the art.

Figure 3C:
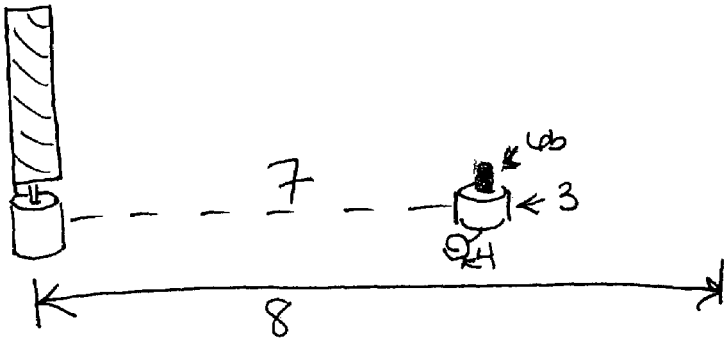
FIG. 3C is a depiction of the RF signal communication being sent to the umpod where the umpod is less than the preset distance away from the handle and is not in alert mode, according to a preferred embodiment of the invention.

The RF signal 7 being transmitted from the transmitter 10 located in the handle 2 of the umbrella 1 will have a limited range, which in the preferred embodiment, corresponds to the preset distance 8. Additional embodiments will allow the user to change the preset distance 8 to any distance less than or equal to the range of the signal 7 being transmitted. When the receiver 11 in the umpod 3 gets too far away from the transmitter 10 in the handle 2, the signal 7 will become too weak for the receiver 11 to continue to sense the signal 7. Upon sensing the lost communication, the umpod 3 goes into "alert" mode and begins vibrating and/or beeping 9, shown in FIG. 3B. In an embodiment with the option of varying the preset distance 8, the umpod 3 will go into "alert" mode when the receiver 11 senses the preset distance 8 has been met, based on the relative signal strength of the received signal 7. As shown in FIG. 3C, when the umpod 3 is returned to within the range of the preset distance 8 from the handle 2, the vibrating and/or beeping 9 of the "alert" mode stops.

Figure 4:
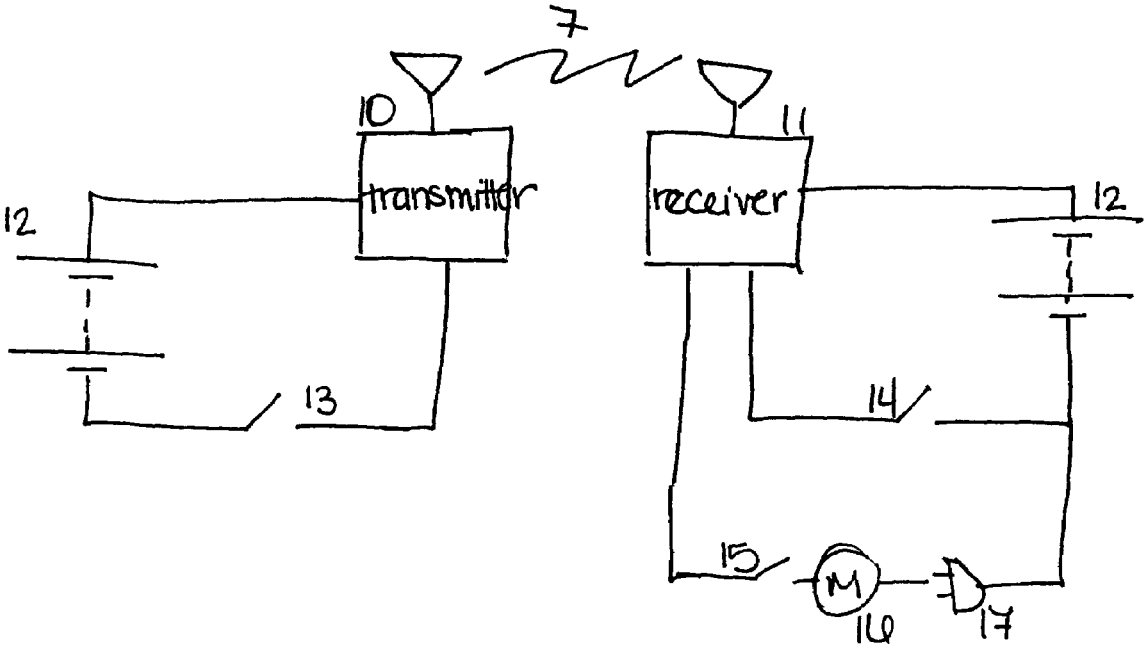
FIG. 4 is a circuit diagram of a preferred embodiment of the invention.

FIG. 4 is a circuit diagram of a preferred embodiment of the present invention. The transmitter 10 and receiver 11 are both powered by battery 12. Switches 13, 14 are in the "off" position when the umpod 3 is connected to the handle 2. The switches 13, 14 move to the "on" position when the umpod 3 is removed from the handle 2. Once switches 13, 14 are in the "on" position, the transmitter 10 transmits the electronic communication 7 which is received by the receiver 11. When the receiver 11 determines that the preset distance 8 has been met, switch 15 will move to the "on" position. The default position for switch 15 is "off". When switch 15 moves to the "on" position, motor 16 and buzzer 17 are activated; this is the "alert" mode which causes the vibrating and/or beeping 9 to occur. When the umpod 3 and therefore the receiver 11 is brought back within the preset distance 8 of the transmitter 10, the switch 15 will return to the "off" position and the vibrating and/or beeping 9 will cease. FIG. 4 shows a circuit diagram for an embodiment including both vibrating and beeping functionality. The present invention may also include only one of motor 16 (vibrating) and buzzer 17 (beeping).

What is claimed as new and desired to be protected by Letters Patent of the United States is:

1. An umbrella comprising a handle having an upper portion and a lower portion, the lower portion of the handle being detachable from the upper portion of the handle and having the ability to receive electronic communication from a transmitter located within the upper portion of the handle, wherein the lower portion of the handle will begin beeping when the lower portion of the handle is separated by more than a preset distance from the upper portion of the handle.

2. The umbrella of claim 1, wherein the lower portion of the handle stops beeping when brought back within the preset distance away from the upper portion of the handle.

3. The umbrella of claim 1, wherein the electronic communication is in the form of a pulsating RF signal sent from the transmitter located within the upper portion of the handle.

4. The umbrella of claim 1, wherein the lower portion of the handle further comprises an attached key ring.

5. The umbrella of claim 1, wherein the electronic communication is activated by a switch located within the upper portion of the handle, the switch being in the "on" position when the lower portion of the handle is detached from the upper portion of the handle and in the "off" position when the lower portion of the handle is attached to the upper portion of the handle.

6. The umbrella of claim 1, wherein the preset distance may be defined as any distance less than or equal to the maximum range of the electronic communication transmitter.

7. An umbrella comprising a handle having an upper portion and a lower portion, the lower portion of the handle being detachable from the upper portion of the handle and having the ability to receive electronic communication from a transmitter located within the upper portion of the handle, wherein the lower portion of the handle will begin vibrating when the lower portion of the handle is separated by more than a preset distance from the upper portion of the handle.

8. The umbrella of claim 7, wherein the lower portion of the handle stops vibrating when brought back within the preset distance away from the upper portion of the handle.

9. The umbrella of claim 7, wherein the electronic communication is in the form of a pulsating RF signal sent from the transmitter located within the upper portion of the handle.

10. The umbrella of claim 7, wherein the lower portion of the handle further comprises an attached key ring.

11. The umbrella of claim 7, wherein the electronic communication is activated by a switch located within the upper portion of the handle, the switch being in the "on" position when the lower portion of the handle is detached from the upper portion of the handle and in the "off" position when the lower portion of the handle is attached to the upper portion of the handle.

12. The umbrella of claim 7, wherein the preset distance may be defined as any distance less than or equal to the maximum range of the electronic communication transmitter.

13. An umbrella comprising a handle having an upper portion and a lower portion, the lower portion of the handle being detachable from the upper portion of the handle and having the ability to receive electronic communication from a transmitter located within the upper portion of the handle, wherein said lower portion of the handle will begin beeping and vibrating when the lower portion of the handle is separated by more than a preset distance from the upper portion of the handle.

14. The umbrella of claim 13, wherein the lower portion of the handle stops beeping and vibrating when brought back within the preset distance away from the upper portion of the handle.

15. The umbrella of claim 13, wherein the electronic communication is in the form of a pulsating RF signal sent from the transmitter located within the upper portion of the handle.

16. The umbrella of claim 13, wherein the lower portion of the handle further comprises an attached key ring.

17. The umbrella of claim 13, wherein the electronic communication is activated by a switch located within the upper portion of the handle, the switch being in the "on" position when the lower portion of the handle is detached from the upper portion of the handle and in the "off" position when the lower portion of the handle is attached to the upper portion of the handle.

18. The umbrella of claim 13, wherein the preset distance may be defined as any distance less than or equal to the maximum range of the electronic communication transmitter.

* * * * *